US005135173A

United States Patent [19]

Cho

[11] Patent Number: 5,135,173

[45] Date of Patent: Aug. 4, 1992

[54] MULTIPLY ADJUSTABLE FAUCET DEVICE

[76] Inventor: Wang M. Cho, 220 S. Roselle, Apt. 224, Schaumburg, Ill. 60193

[21] Appl. No.: 687,943

[22] Filed: Apr. 19, 1991

[51] Int. Cl.[5] ..... B05B 7/26

[52] U.S. Cl. ..... 239/305; 239/310; 222/144.5

[58] Field of Search ..... 239/310, 304, 305, 307; 222/144.5, 129.2, 630

[56] References Cited

U.S. PATENT DOCUMENTS

| | | | |
|---|---|---|---|
| 2,120,774 | 6/1938 | Belmont | 239/304 |
| 4,027,822 | 6/1977 | Usher | 239/310 |
| 4,039,104 | 8/1977 | Mijares, Jr. et al. | 222/144.5 |
| 4,193,520 | 3/1980 | Duffield | 239/310 |
| 4,840,311 | 6/1989 | Shamblin | 239/305 |

*Primary Examiner*—Andres Kashnikow
*Assistant Examiner*—Lesley D. Morris
*Attorney, Agent, or Firm*—Birch, Stewart, Kolasch & Birch

[57] ABSTRACT

A multiply adjustable faucet device includes a body member connected to a water supply line, a shampoo tank and a liquid soap tank, and a shower head, wherein the body member includes a cylindrical housing rotatably receiving a hollow rotor and the hollow rotor has a liquid aperture and outlet apertures, and a rotatable locking member mounted on the hollow rotor, whereby water, a water and shampoo mixture, or a water and liquid soap mixture is supplied by the device or the device is closed corresponding to the rotation of the locking member.

5 Claims, 2 Drawing Sheets

MULTIPLY ADJUSTABLE FAUCET DEVICE

BACKGROUND OF THE INVENTION

1. Field of the Invention

The present invention relates to a multiply adjustable faucet device and more particularly, to a four way adjustable faucet device for installing in a shower room so as to provide a shower of water, water including shampoo, and water including liquid soap by pulling a wire handle attached thereto.

2. Description of the Prior Art

Several types of shower faucet devices having an on/off valve are well known in the art. Such shower faucet devices suffer from a number of disadvantages such as, for example, inconvenience with respect to using shampoo, liquid soap and bar soap since one's hands are in a closed position and it is difficult to adjust the temperature of the shower water while applying the shampoo or soap.

SUMMARY OF THE INVENTION

Accordingly, it is an object of the present invention to provide a multiply adjustable faucet device for overcoming disadvantages of conventional faucet devices.

Another object of the present invention is to provide four way adjustable faucet device for showering with water only, water including shampoo, and water including liquid soap by conveniently only pulling a wire handle attached thereto.

A further object of the present invention is to provide a multiply adjustable faucet device which comprises a cylindrical housing, a hollow rotor rotatably inserted into the cylindrical housing for discharging water or a water mixture through a liquid inlet aperture disposed at the upper portion of the hollow rotor which communicates with supply lines from a shampoo tank and a liquid soap tank, a pair of liquid outlet apertures disposed at the lower portion of the hollow rotor for discharging the water or the water mixture from the liquid passage to a shower head, whereby upon rotating the hollow rotor by pulling a wire handle, the faucet device serves multiple functions.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a multiply adjustable faucet device which includes a body member connected to a water supply line, a shampoo tank and a liquid soap tank, and a shower head, wherein the body member includes a cylindrical housing rotatably receiving a hollow rotor which has a liquid aperture and outlet apertures, and a rotatable locking member mounted on the hollow rotor, whereby water, a water and shampoo mixture, or a water and liquid soap mixture is supplied by the device or the device is closed corresponding to the rotation position of the locking member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
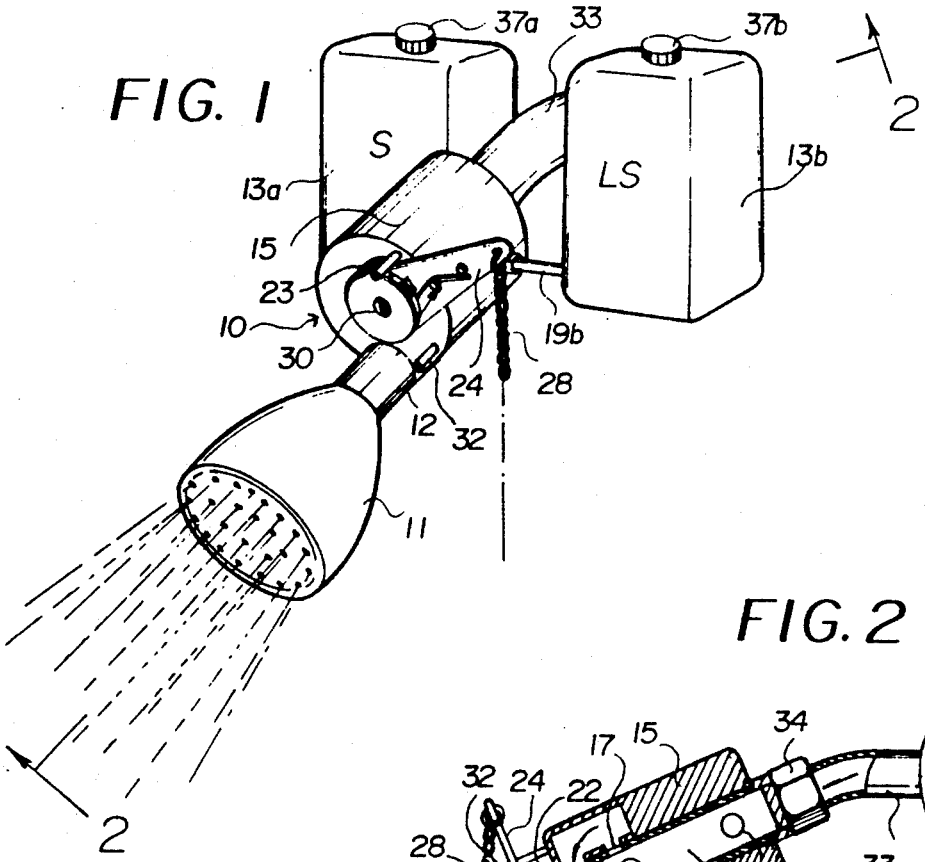
FIG. 1 is a perspective view of a multiple way faucet device according to the present invention.
Figure 2:
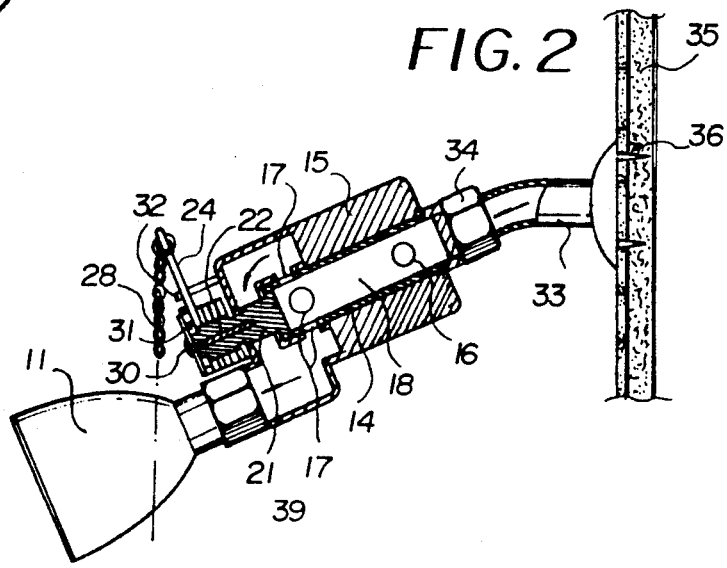
FIG. 2 is a sectional view of FIG. 1, taken along lines 2—2.
Figure 3:
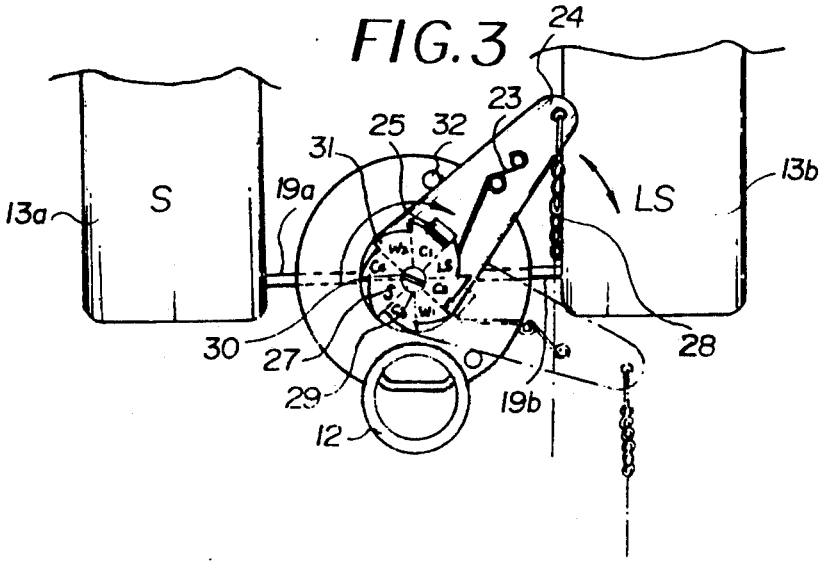
FIG. 3 is a front view of a body member of the multiple way faucet device according to the present invention.

Referring now in detail to the drawings for the purpose of illustrating preferred embodiments of the present invention, the multiple way faucet device as shown in FIGS. 1, 2, and 3, comprises a body member 10, a shower head 11 connected to the lower portion of the body member 10 through a shower bridge 12, a shampoo tank 13*a* and a liquid soap tank 13*b* connected to the upper portion of the body member 10, respectively, and a hollow rotor 14 rotatably inserted into a cylindrical housing 15.

Figure 4:
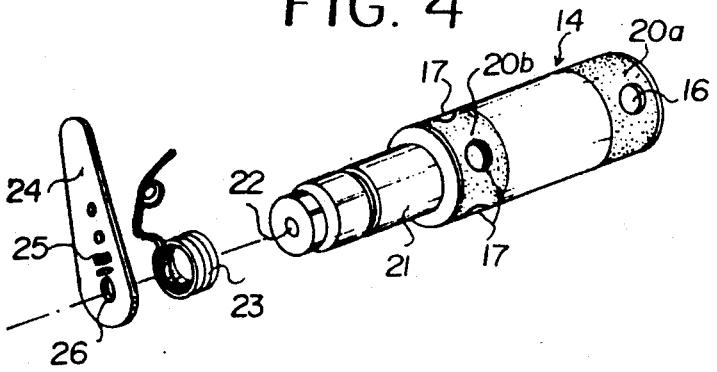
FIG. 4 is a perspective view of a hollow rotor of the multiple way faucet device with a locking member according to the present invention.
Figure 5:
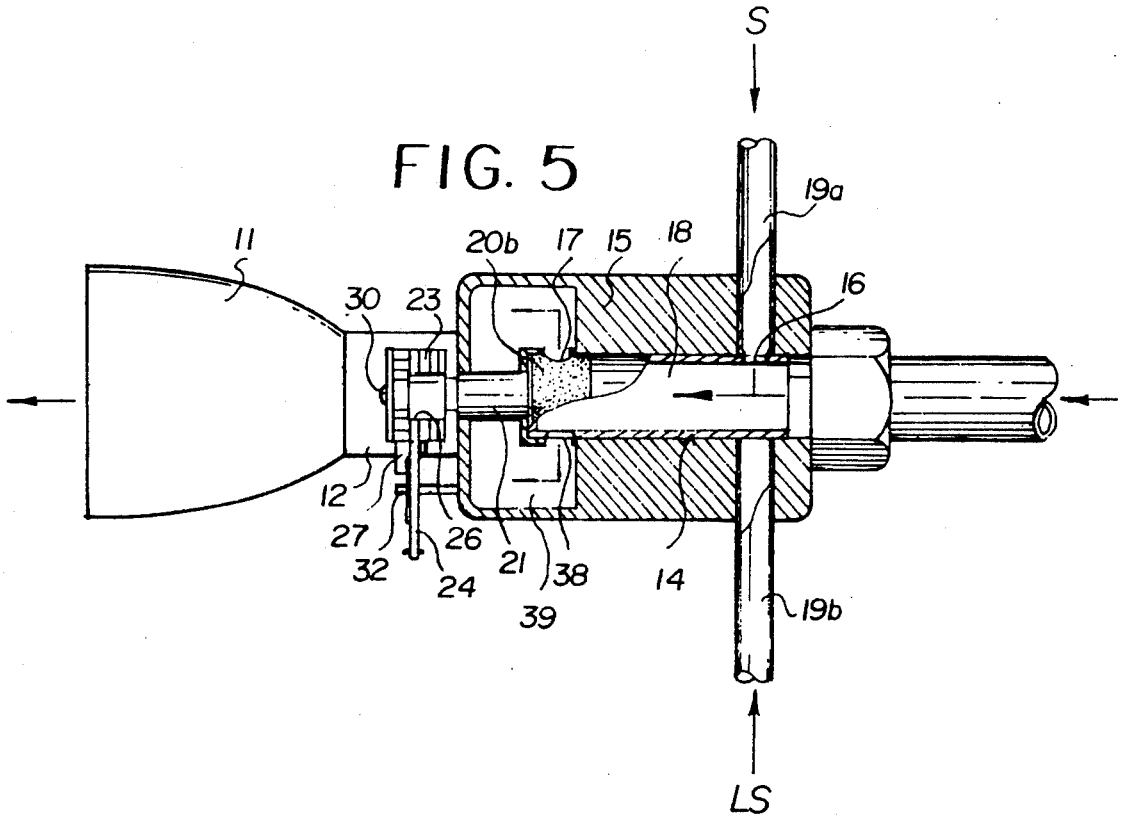
FIG. 5 is a sectional view of the body member of the multiple way faucet device according to the present invention showing the water and mixture flow systems.

As shown in FIGS. 4 and 5, the hollow rotor 14 includes a liquid inlet aperture 16 disposed at the upper portion thereof for communicating with a shampoo supply line 19*a* of the shampoo tank 13*a* and a liquid soap supply line 19*b* of the liquid soap tank 13*b* and two pairs of first outlet apertures 17 disposed at the lower portion thereof for discharging water or water mixture from a passage 18 which is a hollow portion 18 of the hollow rotor 14. At this time, the liquid inlet aperture 16 is disposed in parallel to one of first outlet apertures 17. The cylindrical housing 15 includes a pair of second outlet apertures 38 disposed at the lower portion thereof for mating with one of the pair of first outlet apertures 17 and a space 39 disposed in the end portion thereof for becoming a water passage from the apertures 17 and 38 to the shower head 11. The hollow rotor 14 is provided with a pair of rubber bands 20*a* and 20*b* wrapped around the liquid inlet aperture 16 and the first outlet apertures 17 of the hollow rotor 14 for preventing water from leaking and liquid and the hollow rotor 14 from abrasion and the cylindrical housing 15 when the hollow rotor 14 is smoothly rotated in the cylindrical housing 15.

As shown in FIGS. 2, 3, and 5, the hollow rotor 14 is provided with a shaft 21 extending from the end portion of the hollow rotor 14, a spring 23 wound around a small end portion of the shaft 21, a lever 24 having a locking stopper 25, and a rotatable locking member 27. A screw nail 30 is inserted into an elongated aperture 22 of the shaft 21 through an aperture 29 of the lever 24 and an aperture 29 of the rotatable locking member 27 for assembling the rotatable locking member 27, the lever 24, and the spring 23 with the shaft 21.

The lever 24 further includes a wire handle 28 connected to the top portion thereof for pulling the wire handle 28 and the lever 24 is biased by the spring 23 and against the rotatable locking member 27 through the locking stopper 25. The lever 24 can be moved between a pair of lever stoppers 32 fixed to the bottom of the cylindrical housing 15. The rotatable locking member 27 contains a plurality of teeth 31, for example, eight teeth, for locking to the locking stopper 25 fixed on the lever 24 (FIGS. 3 and 4).

As shown in FIGS. 1 and 2, the body member 10 is connected to a water supply line 33 through a nut 34. And the water supply line 33 is fixed to a wall 35 of a shower room (not shown) by a plurality of screws 36. The shampoo tank 13*a* and the liquid soap tank 13*b* have supply lines 19*a* and 19*b* and caps 37*a* and 37*b*, respectively, and are suspended by plates (not shown).

The multiply adjustable faucet device according to the present invention operates as follows.

As shown in FIG. 3, when the pair of second outlet apertures 38 is dislocated in parallel to one pair of first liquid outlet apertures 17, the faucet device is in a first closed position ($C_1$).

Upon first pulling the wire handle 28, the liquid inlet aperture 16 is positioned to communicate with the liquid soap line 19*b* and one pair of the first outlet apertures 17 are moved to communicate with the pair of second outlet apertures 38, whereby the water from the water supply line 33 is mixed with the liquid soap from the liquid soap tank 13*b* and passed along the passage 18 in the hollow rotor 14, and finally discharged to the shower head 11 through first and second outlet apertures 17 and 38. That is, the faucet device is in a liquid soap operation position (LS).

Upon a second pulling of the wire handle 28, the pair of second outlet apertures 38 is dislocated in parallel to one pair of first liquid outlet apertures 17, and the faucet device is in a second closed position again ($C_2$).

When the user pulls the wire handle 28 a third time, one pair of first outlet apertures 17 is positioned to communicate with the pair of second outlet apertures 28 so that the water from the water supply line 33 flows to the shower head 11 through the first and second apertures 17 and 38. That is, the faucet device is in a first water operation position ($W_1$).

Upon a fourth pulling of the handle wire 28, one pair of first liquid outlet apertures 17 and the second liquid outlet apertures 38 are dislocated with respect to each other. That is, the faucet device is placed in a third closed position ($C_3$).

As shown in FIG. 5, when the user pulls the wire handle 28 a fifth time, the liquid inlet aperture is positioned to communicate with the shampoo line 19*a* and the pair of first outlet apertures 17 is positioned to communicate with the pair of second outlet apertures 38 whereby the water from the water supply line 33 is mixed with the shampoo from the shampoo tank 13*a* and passed along the passage 18 in the hollow rotor 14, and finally discharged to the shower head 11 through the first and second outlet apertures 17 and 38. That is, the faucet device is in a shampoo operation position (S).

Upon a sixth pulling of the wire handle 28, the faucet device is placed in a fourth closed position which is essentially the same as the above-described closed operation process ($C_4$).

When the user pulls the wire handle 28 a sixth time, one pair of first outlet apertures 17 is positioned to communicate with the pair of second outlet apertures 38 so that the faucet device is in a second water operation position ($W_2$).

Finally, upon pulling the wire handle 28 an eighth time, the faucet device is placed in the first closed position, that is, the original position ($C_1$).

Thus, the hollow rotor 14 is rotated by pulling the wire handle 28 a total of eight times. If necessary, the user can also adjust the positions, for example, the liquid soap operation position, shampoo operation position, or water operation position. When the lever 24 is operated one time, the hollow rotor 14 rotates only 45° so that the lever 24 is rotated once, i.e. 360° , by pulling the wire handle 28 eight times. Also, when the user pulls the handle wire 28 and releases it, one of teeth 31 of the rotatable locking member 27 is tightly locked to the locking stopper. However, at this time, the lever 24 moves between both lever stoppers 32 (FIG. 3).

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A multiply adjustable faucet comprising:

a water supply line, a shampoo tank containing shampoo, said shampoo tank having a shampoo supply line, a liquid soap tank containing liquid soap, said liquid soap tank having a liquid soap supply line, a body member connected to said water supply line, said shampoo supply line, and said liquid soap supply line for supplying water, a shampoo and water mixture, and a liquid soap and water mixture thereby, and being connected to a shower head for sending or discharging said water mixtures therefrom, said body member including:

a cylindrical housing having a pair of cylinder-apertures and a space disposed at the lower portion thereof, a hollow rotor rotatably inserted into said cylindrical housing, said hollow rotor having a hollow stem, a liquid inlet aperture disposed at the upper portion thereof for operatively communicating with said shampoo supply line and said liquid soap supply line, and two pairs of rotor-apertures disposed at the lower portion thereof for operatively communicating with said pair of cylinder-apertures so as to discharge water and liquid therethrough, means for rotating mounted to said hollow rotor for rotating the rotor to a plurality of positions which communicate with the supply lines or close the device, whereby upon operating the rotating means, the water, the shampoo and water mixture, and the liquid soap and water mixture can be discharged from the shower head or the device is closed.

2. The multiply adjustable faucet device of claim 1, wherein the means for rotating includes:

a lever having a locking stopper, a rotatable locking member having multiple teeth, a spring for biasing the lever, and a pair of lever stoppers for moving the lever therebetween.

3. The multiply adjustable faucet device of claim 2, wherein the multiple teeth number eight.

4. The multiply adjustable faucet device of claim 2, wherein the lever has a wire handle for pulling the lever thereby.

5. The multiply adjustable faucet device of claim 1, wherein the body member is provided with a passage bridge for connecting to the shower head.

* * * * *